US005568178A

United States Patent [19]

Hara et al.

[11] Patent Number: 5,568,178

[45] Date of Patent: Oct. 22, 1996

[54] METHOD AND APPARATUS FOR DRIVING EDGE-EMISSION TYPE ELECTROLUMINESCENT ELEMENTS, METHOD AND APPARATUS FOR DRIVING A LINE HEAD HAVING A PLURALITY OF EDGE-EMISSION TYPE ELECTROLUMINESCENT ELEMENTS AND IMAGE FORMING APPARATUS FOR FORMING IMAGE DATA ON

[75] Inventors: Kei Hara, Shizuoka-ken; Shigeru Morino, Numazu, both of Japan

[73] Assignee: Kabushiki Kaisha TEC, Tokyo, Japan

[21] Appl. No.: 167,335

[22] Filed: Dec. 15, 1993

[30] Foreign Application Priority Data

Dec. 25, 1992 [JP] Japan ..... 4-347268

[51] Int. Cl.[6] ..... B41J 2/47; B41J 2/435; B41J 2/45

[52] U.S. Cl. ..... 347/237; 347/238

[58] Field of Search ..... 347/237, 130, 347/131, 132, 240, 238; 345/92, 77, 76; 355/237

[56] References Cited

U.S. PATENT DOCUMENTS 4,386,352 5/1983 Nonomura ..... 340/784
5,128,696 7/1992 Watanabe ..... 347/155
5,233,370 8/1993 Hara et al. ..... 347/107
5,341,195 8/1994 Satoh ..... 355/237

FOREIGN PATENT DOCUMENTS 62-106479 5/1987 Japan .

*Primary Examiner*—Benjamin R. Fuller
*Assistant Examiner*—Thinh Nguyen
*Attorney, Agent, or Firm*—Frishauf, Holtz, Goodman, Langer & Chick

[57] ABSTRACT

An apparatus for driving edge-emission type electroluminescent elements to emit light to expose an image carrier and to form image data clearly on the image carrier. The edge-emission type electroluminescent elements have electrodes and emit light when a potential difference across the electrodes exceeds a preset threshold value. Electric pulses are supplied to the electrodes of the edge-emission type electroluminescent elements to cause the potential difference across the electrodes to exceed the preset threshold value so that the edge-emission type electroluminescent elements emit light. A series of pulses are supplied for each pixel of image data. The series of pulses includes a first set of pulses supplied at a first cycle to cause the edge-emission type electroluminescent elements to emit light to expose the image carrier, and a second set of pulses supplied at a second cycle slower than the first cycle to cause the edge-emission type electroluminescent elements to emit light to maintain exposure of the image carrier.

12 Claims, 5 Drawing Sheets

METHOD AND APPARATUS FOR DRIVING EDGE-EMISSION TYPE ELECTROLUMINESCENT ELEMENTS, METHOD AND APPARATUS FOR DRIVING A LINE HEAD HAVING A PLURALITY OF EDGE-EMISSION TYPE ELECTROLUMINESCENT ELEMENTS AND IMAGE FORMING APPARATUS FOR FORMING IMAGE DATA ON

BACKGROUND OF THE INVENTION

1. Field of the Invention

The present invention relates to an image forming device for forming image data on a photosensitive drum in an electronic printing apparatus for example, with the use of a line head comprised of edge-emission type electroluminescent elements.

2. Description of the Related Art

Generally, an edge-emission type EL (electro-luminescent) element 1 has a multi-layer structure as shown in FIG. 7. The multi-layer structure comprises a thin film-like active layer 2 formed of an active element-containing zinc sulfide, dielectric layers 3, 4 surrounding the active layer 2 and flat plate electrodes 5 and 6 formed on the upper and lower surfaces of the dielectric layers 3 and 4, respectively. The edge-emission type EL element 1 is used for a line head for forming an exposure image on a photosensitive body of an electric field emission type printer.

FIG. 8 shows a relation between the timing of an electric pulse P applied to the edge emission type EL element 1 and a quantity of light emitted from the EL element 1 at that time. At a point of time, A, a potential difference exceeding a threshold voltage vth is applied across the plate electrodes 5 and 6 in the EL element 1 to emit light from the EL element 1. At this time, the quantity of light emitted rises abruptly. Upon arrival at a predetermined point of time, B, the light quantity is gradually declined.

As shown in FIG. 9, a line head 7 is formed of one array of the edge-emission type EL elements 1 provided on a substrate 8. A rod lens array, not shown, is arranged in an opposed relation to the forward ends of the EL elements in the line head 7.

The EL elements 1 in the line head 7 are arranged, as one array, in parallel (major scanning direction) to the axial direction of, for example, a cylindrical photosensitive drum, not shown. While the photosensitive drum is rotated by one line corresponding to one pixel width, the associated EL elements 1 emit light a plurality of times at the same cycle.

By so doing, the respective pixel is formed on the photosensitive body through exposure and one line is recorded, by the line head 7, on the photosensitive drum through exposure.

In the conventional image forming device, in order to form one pixel on the photosensitive drum by the EL elements, the EL elements controllably emit light a plurality of times at the same cycle as shown, for example, in JPN PAT APPN KOKAI PUBLICATION 62-106479.

As shown in FIG. 10, for example, upon light emission of the EL element by the application of one pulse it is not possible to exceed a quantity of light, C, adequate to illuminate the photosensitive drum. Further, even if the pulses are applied to the EL elements continuously three times at a cycle T1, it is not possible to exceed the adequate quantity of light, C, and the quantity of light, C, adequate to illuminate the photosensitive drum can be obtained only through the emission of light by the application of the fourth and subsequent pulses.

That is, since the photosensitive drum is not adequately exposed with emission light by the application of the first few pulses, there is a problem that one pixel is not completely recorded with emission light on the photosensitive drum. As a result, when the image forming apparatus is used for a printer, a thin line, such as a dot line, that is, a pixel line, cannot be clearly printed on a surface.

SUMMARY OF THE INVENTION

It is an object of the present invention to improve the formation of an image on a photosensitive drum when edge-emission type electroluminescent elements are used as a line head in an image forming device.

It is another object of the invention to promptly increase the quantity of light from a line head including edge emission-type electroluminescent elements and to maintain the quantity of light adequate to illuminate the photosensitive drum in an image forming device.

According to one aspect of the present invention there is provided a method for driving edge-emission type electroluminescent elements to form each pixel of image data clearly on an image carrier through exposure with light, comprising:

a one-pixel starting step of supplying those first given pulses of a plurality of pulses forming one pixel of image data to both electrodes of the electroluminescent elements at a faster cycle than a cycle capable of maintaining a quantity of emission adequate to expose the image carrier, the pulses creating a potential difference exceeding a preset threshold value; and a one pixel ending step of subsequently supplying the remaining pulses to the electrodes, at a cycle capable of maintaining the quantity of emission, the pulses creating a potential difference exceeding the threshold value.

According to another aspect of the present invention, there is provided an apparatus for driving edge-emission type electroluminescent elements to form image data clearly on an image carrier through exposure with light, comprising:

a line head having edge-emission type electroluminescent elements;

power supply means for supplying electric powers creating potential differences exceeding a preset threshold value to both electrodes of the electroluminescent elements; and pulse control means for forming a plurality of pulses for each pixel of the image data from the electric powers which are supplied from the power supply means, wherein, out of the plurality of pulses, those first given pulses are supplied at a faster cycle than a cycle capable of maintaining a quantity of emission adequate to expose the image carrier and the remaining pulses are supplied at the cycle capable of maintaining the quantity of emission.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
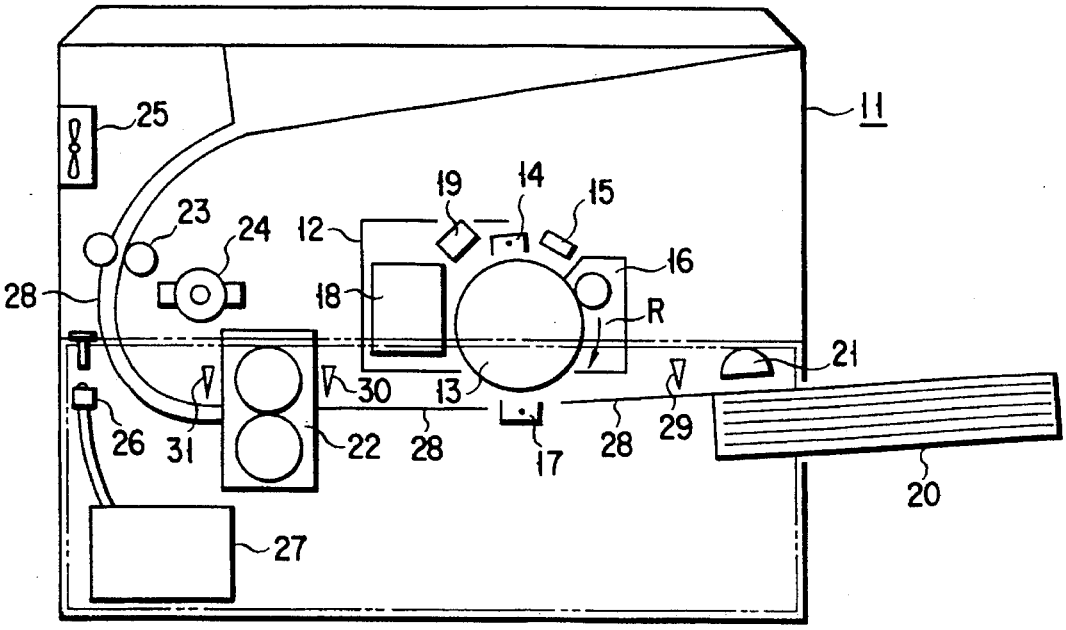
FIG. 1 is a diagram schematically showing an edge-emission type EL printer according to an embodiment of the present invention.

Referring to the drawings, one embodiment of the present invention will be explained below as being applied to an edge-emission type EL (electroluminescent) printer.

FIG. 1 shows a general arrangement of the edge-emission type EL printer. In the substantially middle of the printer body 11, a photosensitive unit 12 is provided which is detachably mounted in the printer body 11. The unit 12 includes a photosensitive drum 13, as an image carrier with a photosensitive material formed on its surface.

The photosensitive drum 13 is rotatably driven in a direction as indicated by an arrow R. In accordance with the electrophotographic process, the associated component parts as will be set out below are sequentially arranged around the photosensitive drum 13 along the rotational direction. That is, the component parts thus arranged are a charger 14 for uniformly charging the surface of the photosensitive drum 13, a line head 15 for exposing, with light, the photosensitive drum 13 charged with the charger 14 and for forming image data as a latent image with the light exposure, a toner developer 16 for applying a toner on the photosensitive drum 13 and for forming a visible toner image on the photosensitive drum 13, a transfer charger 17 for transferring the toner image from the photosensitive drum 13 to an image forming medium, e.g., a paper sheet, a cleaning unit 18 for removing any residual toner from the photosensitive drum 13, and a discharger lamp 19 for discharging the surface of the photosensitive drum 13.

A sheet supply cassette 20 in which a plurality of paper sheets are stacked is provided near the inlet of the printer body 11 at an area upstream of the transfer charger 17. A pick-up roller 21 is provided to pick out the paper sheet one by one from cassette 20 in a predetermined timing toward the transfer charger 17.

A heat fixing unit 22 is provided downstream of the transfer charger 17 to fix the toner image on the paper sheet so that a transferred image (toner image) is obtained as a permanent image. Further downstream of the heat fixing unit 22 a discharge roller 23 is provided which discharges the sheet toward an outside.

within the printer body 11 are provided a motor 24 for driving photosensitive drum 13 and other movable elements described above, a fan 25, an interlock switch 26 for detecting the opening of a housing of the printer body 11, and a DC power source 27.

A sheet conveying path 28 extends from the sheet conveying section 20 through the transfer charger 17 and heat fixing unit 22 to the discharge roller 23. Under control of the motor 24 the sheet is conveyed along the sheet conveying path 28. Paper sensors 29, 30 and 31 are provided along the sheet conveying path 28, one near the pick-up roller 21 and one at the inlet and one at the outlet of the heat fixing unit 22. These paper sensors 29, 30 and 31 detect the passing of the sheet in these positions, respectively.

Figure 2:
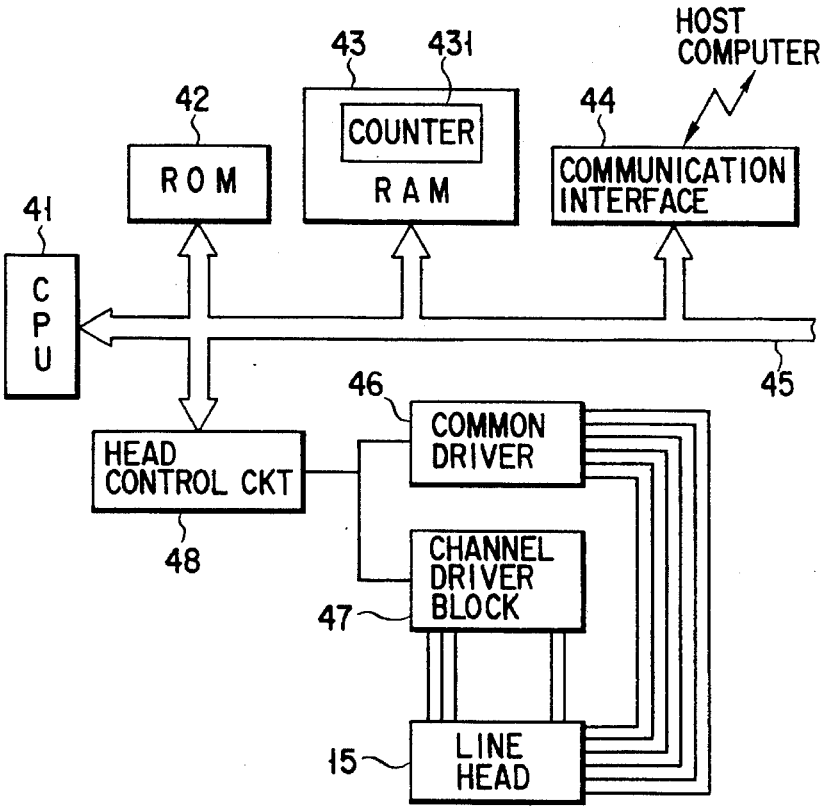
FIG. 2 is a block diagram showing a schematic major circuit arrangement of the printer shown in FIG. 1.

FIG. 2 is a block diagram showing a major circuit diagram of an electric field emission type EL printer. A CPU (control processing unit) 41 constituting a control unit body is provided to carry out an over all control of the printer.

A ROM (read only memory) 42 stores program data for processing by CPU 41. A RAM (random access memory) 43 provides various memory areas which are used when processing is made by CPU 41. A communication interface 44 is connected to a host computer via a communication line. CPU 41 is connected via a system bus 45 to ROM 42, RAM 3 and communication interface 44.

A counter 431 is provided in RMA 43 to count the number of light emissions when one pixel is formed by the line head 15.

A common driver 46 and channel driver block 47 control a high voltage applied to a line head 15. A head control circuit 48 controls the common driver 46 and channel driver block 47. The head control circuit 48 is connected to CPU 41 via the system bus 45.

Figure 3:
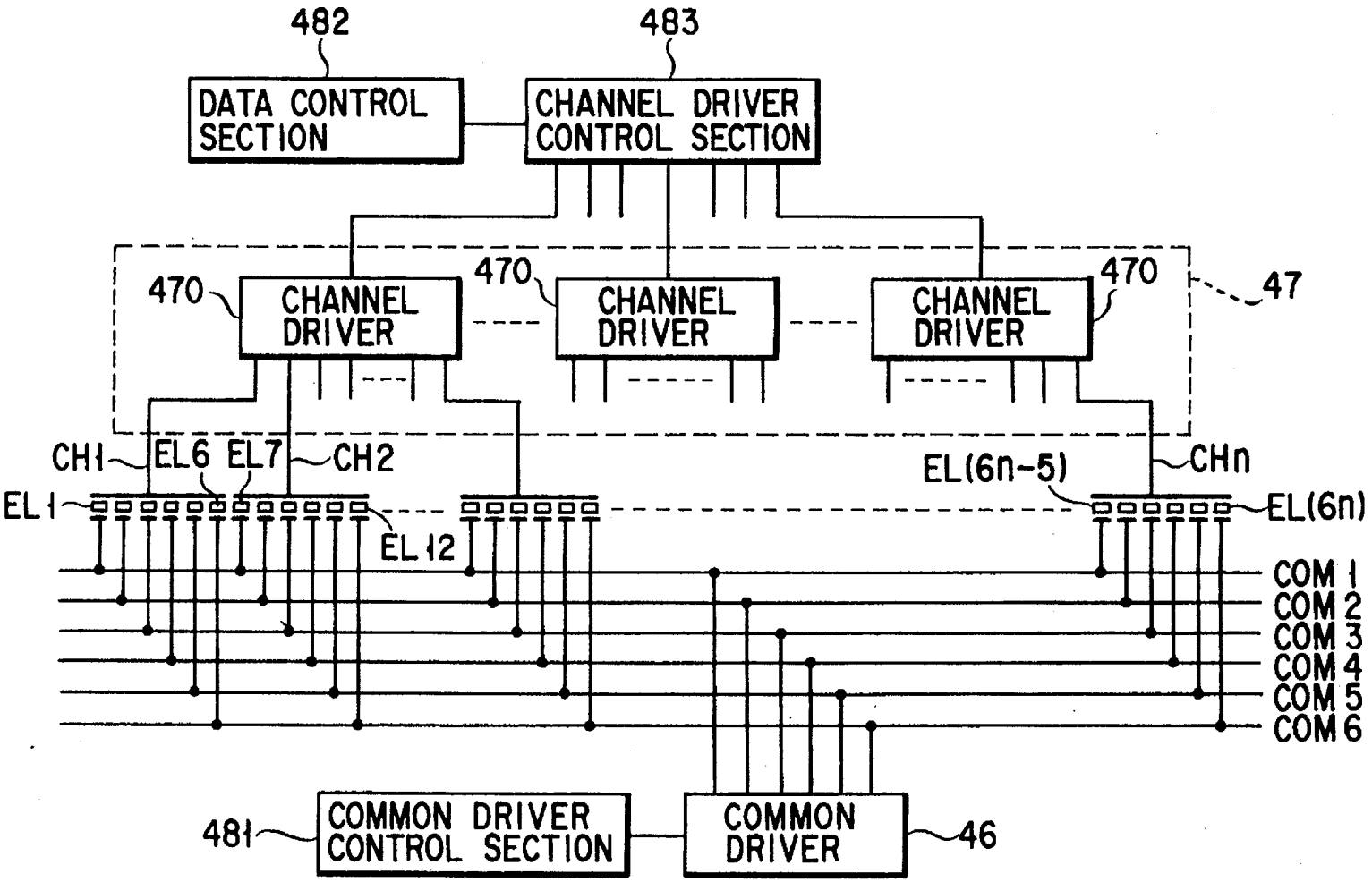
FIG. 3 is a view showing a driving circuit arrangement of a line head in the embodiment shown in FIG. 1.

FIG. 3 is a view showing a detailed driving circuit arrangement of the line head 15. The line head 15 comprises a 6n number of edge-emission type EL elements EL1 to ELn arranged in one array in a parallel relation to the axis of the photosensitive body. The line head 15 has its respective six edge-emission type EL elements, such as EL1 to EL6, EL7 to EL12, . . . , EL(6n–5) to EL(6n), controlled as one block.

Those first edge-emission type EL elements EL1, E7, . . . , EL(6n–5) of the respective blocks in the line head 15 are commonly connected through their one-side flat plate electrodes (common electrodes) to a first common line COM1 for supplying high voltage from the common driver 46. The second edge-emission type EL elements EL2, EL8 , . . . , EL(6n–4) in the respective blocks in the line head are commonly connected through their one-side flat plate electrodes (common electrodes) to the second common line COM2 for supplying high voltage from the common driver 46. In this way, the third, fourth, fifth and sixth edge-emission type EL elements in the respective blocks in the line head are commonly connected through their one-side plate electrodes (common electrodes) to the third, fourth, fifth and sixth common lines COM3, COM4, COM5 and COM6, respectively, for supplying corresponding high voltages from the common driver 46.

Figure 4:
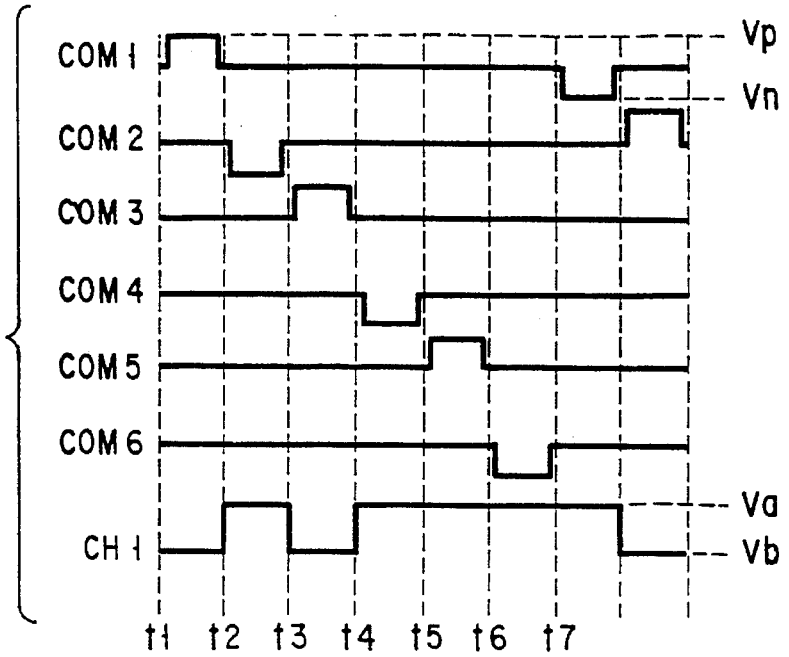
FIG. 4 shows one form of voltage application timing of common and channel drivers in the embodiment shown in FIG. 1.

The common drivers 46 alternately deliver positive high voltage vp and negative high voltage Vn in a predetermined cycle to the respective common lines COM1 to COM6. Further, the common driver 46 sequentially delivers the positive high voltage Vp and negative high voltage Vn, in a ⅙ time shift relation, to the respective common lines COM1 to COM6. Hence the output waveforms of the respective common lines COM1 to COM6 are as shown in FIG. 4.

The channel driver block 47 comprises a plurality of channel drivers 470. The respective channel driver 470 has a predetermined number of channels for supplying the high voltage. A number , n, of channels in total are provided in the channel block 47, the number of channels corresponding to the number of blocks, n, of the line head 15.

To the respective blocks of the line head 15 the channels CH1 to CHn of the channel driver block 47 are connected in one-to-one correspondence relation. That is, those respective six EL elements of the respective blocks are commonly connected to the channels CH1 to CHn through (their other-side flat plate electrodes) constituting channel electrodes. For example, those edge-emission type EL elements EL1 to EL6 of the first block are commonly connected through the other-side flat plate electrode to the channel CH1.

The respective drivers 470 in the channel driver block 47 selectively deliver any one of a positive high voltage Va or a negative high voltage Vb to the respective channels CH1 to CHn on the basis of image data.

A potential difference across the common electrode and the channel electrode of the respective edge-emission type EL elements EL1 to EL(6n) is determined by a difference between a voltage applied from the common lines COM1 to COM6 and a voltage applied from the channels CH1 to CHn.

The potential difference between the positive high voltage Vp and the negative high voltage Vb and that between the negative high voltage vn and the positive high voltage Va are so set as to exceed a threshold voltage, at which the EL element emits light, and the potential difference between the respective voltages vp, Vn, Va and Vb and a ground level (Ov) is so set that it does not exceed the threshold voltage.

Another method is by setting the positive high voltage Vp or negative high voltage Vn to be greater than the threshold voltage and the potential difference between the positive high voltage Vp and the positive high voltage Va and that between the negative high voltage Vn and the negative high voltage Vb to be lower than the threshold voltage.

Figure 5:
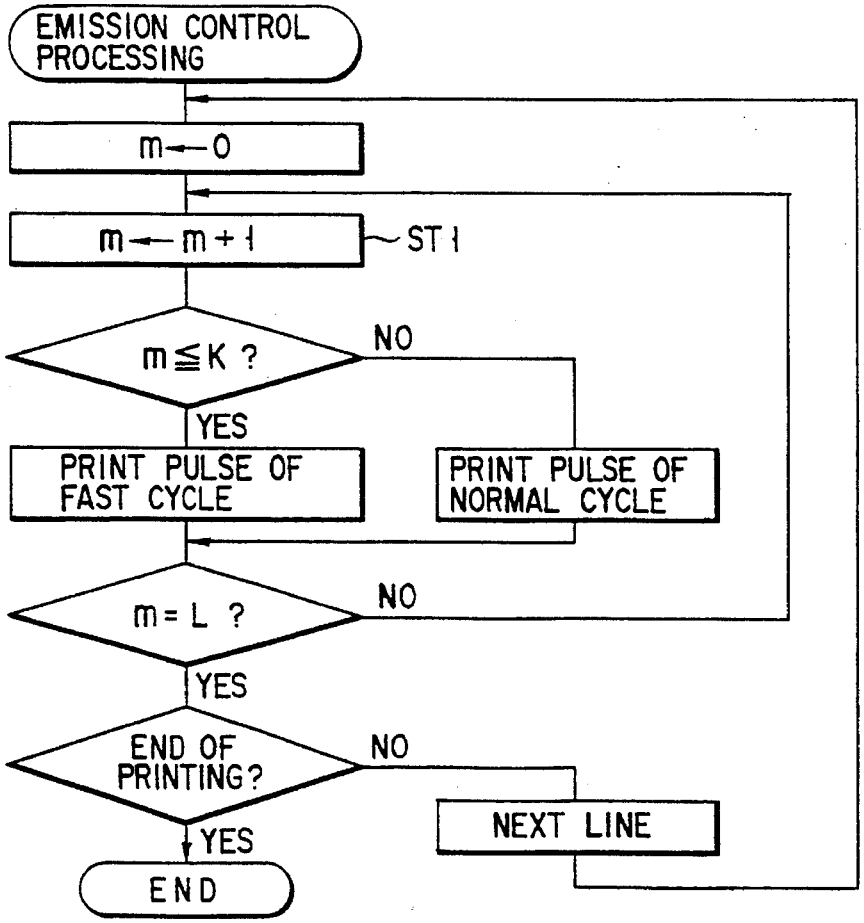
FIG. 5 is a view showing a flow of emission control processing in the embodiment shown in FIG. 1.

FIG. 5 shows a flow of light emission control processing by CPU 41.

First 0 is set to a count value m of the counter 431.

Then one (1) is added to the count value m of the counter 431 at step 1 (ST1). A result of addition is again set as a count value m of the counter 431.

Here confirmation is made as to whether or not the count value m of the counter 431 is equal to, or less than, a cycle change count value K. In the case where the count value m is equal to, or less than, the cycle change count value K (for example, K=4), the YES-path is taken. The common driver 46 and channel driver block 47 are controlled at a predetermined fast cycle and pulses applied to common electrodes and channel electrodes of EL elements from common driver 46 and channel driver block 47 are produced at the fast cycle. Thus, the edge-emission type EL elements emit light with the fast-cycle print pulse and a quantity of light from the EL elements is increased rapidly. However, at this moment, a quantity of light from the edge-emission type EL elements is not enough to expose the photosensitive drum 13. On the other hand, in the case where the count value m is greater than the count value K, the No-path is taken. The common driver 46 and channel driver block 47 are controlled at a predetermined slow cycle and a light which has a quantity enough great to expose the photosensitive drum 13 is emitted from the EL elements. Therefore, the EL elements emit light at a print pulse of a normal cycle.

Then it is determined whether or not the count value m of the counter 431 is equal to the number of light emissions, L, (for example, 8) corresponding to one pixel. Unless the count value m is equal to the number of light emissions, control is returned back to ST1. If, on the other hand, the count value m is equal to the number of light emissions, L, it is determined whether or not printing is ended.

Here, if printing is determined as being not ended, the print data of the next line is read out and control goes back to the start of the light-emission control processing. If, on the other hand, printing is determined as being ended, the light emission control processing is ended.

In the present embodiment thus arranged, image data (print data) is supplied from a host computer via a communication interface 44 and fed to the head control circuit 48 for each line of the image data supplied.

The head control circuit 48 controls the common driver 46 and channel driver block 47 on the basis of the image data of each line and the image data is formed by the line head 15 on the photosensitive body for each line through exposure with light.

As disclosed in FIG. 4, for example, at time t1 to t2, a positive high voltage Vp is output to COM1 and a negative high voltage Vb is output to CH1. Thus a potential difference vp–vb is applied to the EL element EL1 and it exceeds the threshold voltage for the light emission of the EL element, so that light emits from the EL element EL1.

At time t2 to t3, a negative high voltage Vn is output to COM2 and a positive high voltage Va is output to CH1. Thus a potential difference Vn–Va is applied to the EL element EL2 and the potential difference Vn–Va exceeds, i.e., falls below, the threshold voltage (negative threshold voltage), so that the EL element EL2 emits light.

At time t3 to t4, a positive high voltage Vp is output to COM3 and a negative high voltage Vb is output to CH1. Thus a potential difference Vp–Vb is applied to the EL3 and it exceeds the threshold voltage, so that the EL element EL3 emits light. At time t4 to t5, a negative high voltage Vn is output to COM4 and a positive high voltage Va is output to CH1. Thus a potential difference Vn–Va is applied to the EL element EL4 and it exceeds, that is, falls below, the threshold voltage (the negative threshold voltage), so that light emits from the EL element EL4.

At time t5 to t6, a positive high voltage Vp is output to COM5 and a positive high voltage Va is output to CH1. Thus a potential difference Vp–Va is applied to the EL element EL5 and it does not exceed the threshold voltage, so that no light emits from the EL element EL5.

At time t6 to t7, a negative high voltage Vn is output to COM6 and a positive high voltage Va is output to CH1. Thus a potential difference Vn–Va is applied to the EL element EL6 and it exceeds, that is, falls below, the threshold value (negative threshold voltage). As a result, light emits from the EL element EL6.

For the other channels CH1 to CHn, either one of the positive high voltages Va and Vb is similarly output based on the image data so that the emission/no emission control is performed for the EL elements EL7 to EL(6n).

By so doing, out of a plurality of emissions forming one line, the first emission is ended and, at that time, a count value "1" is set to the counter 431. At the time t7, one (1) is added to the count value "1" so that the count value of the counter 431 is set to 2. The second emission is started.

Until the count value of the counter 431 becomes greater than the cycle change number (4), the above-mentioned first emission cycle is carried out at a faster cycle than a normal cycle, that is, a slower cycle capable of maintaining a quantity of light emission adequate to expose the photosensitive body. When the count value of the counter 431 becomes greater than the cycle change number K, the emission cycle is performed at the normal mode until the last L-th (8) emission is effected.

Figure 6:
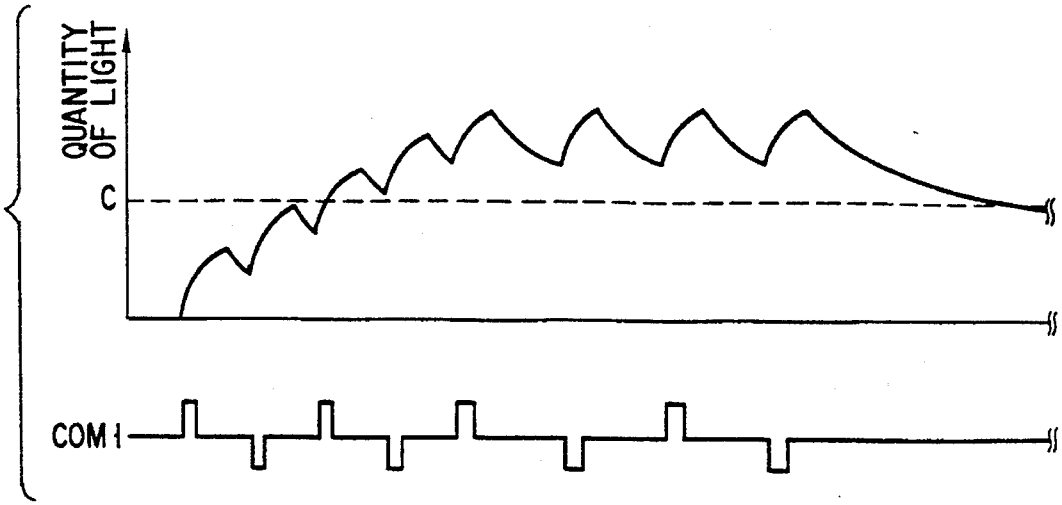
FIG. 6 is a view showing a relation of the timing of a voltage application to a common line COM1 and a quantity of light from an edge-emission type EL element EL1 in the embodiment shown in FIG. 1.
Figure 7:
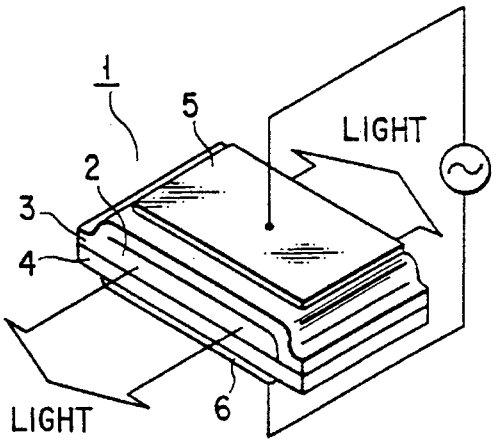
FIG. 7 is a view showing an arrangement of the edge-emission type EL element.
Figure 8:
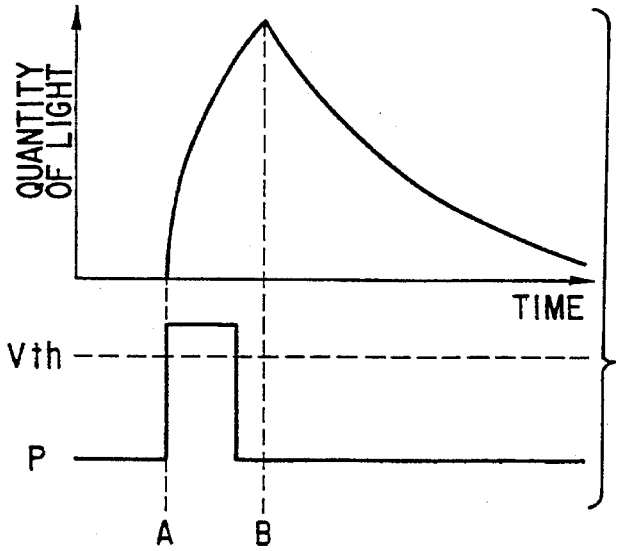
FIG. 8 is a view showing the emission characteristic of the edge-emission type EL element.
Figure 9:
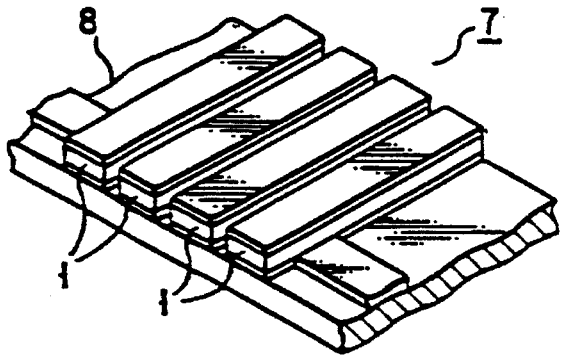
FIG. 9 is a view showing an arrangement of a line head comprised of edge-emission type EL elements.
Figure 10:
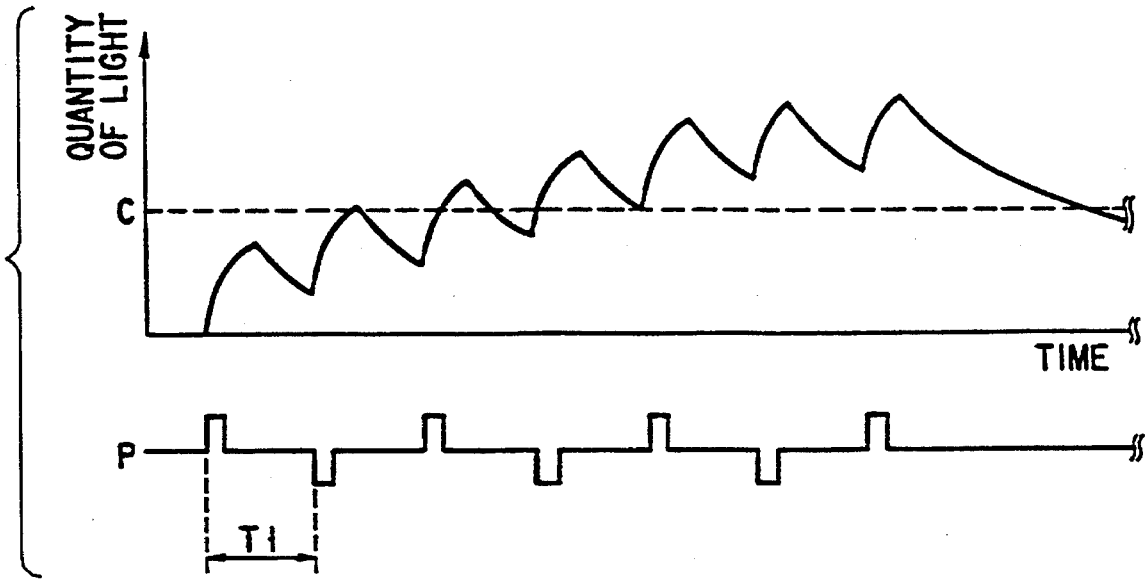
FIG. 10 PRIOR ART
FIG. 10 is a view showing a relation of the timing of an application pulse and a quantity of light from edge-emission type EL elements in a conventional apparatus.

When an L number of emissions is all to be made for one pixel, corresponding pulses are output to the common line COM1 as shown, for example, in FIG. 6, and the quantity of emission is increased by the application pulses. Here, the emission is made at the faster cycle, until the fourth emission is effected, and the fifth emission and subsequent emissions are done at the normal cycle. From the above it is seen that the quantity of light emission, C, adequate to expose the photosensitive drum can be obtained by the third emission.

According to the present invention, a counter 431 is provided for counting the number of emissions forming one pixel. When the count value of the counter 431 is equal to, or less than, the cycle change number K(4), the EL elements emit light at a faster cycle than the normal cycle. Thus, a quantity of light emitted from EL elements increases rapidly. When, on the other hand, the count value of the counter 431 is greater than the cycle change number K, a quantity of light adequate to form image data on the photosensitive body can be reached, at an earlier time from the start of emission, by emitting light from the EL elements at the normal cycle. It is, therefore, possible to clearly form one pixel on the photosensitive body and hence to clearly print a thin line, such as one dot line.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for driving edge-emission type electroluminescent elements to emit light to expose an image carrier and to form image data clearly on the image carrier, comprising:

a one-pixel starting step of supplying a first set of pulses of a series of pulses forming one pixel of image data to electrodes of the electroluminescent elements at a first cycle, the first set of pulses causing a potential difference across the electrodes to exceed a preset threshold value at which the electroluminescent elements emit light; and a one-pixel ending step, continuous with said one-pixel starting step, of supplying a second set of pulses of the series of pulses forming one pixel of image data to the electrodes of the electroluminescent elements at a second cycle slower than the first cycle, the second set of pulses causing a potential difference across the electrodes to exceed the preset threshold value at which the electroluminescent elements emit light; and wherein the electroluminescent elements emit sufficient light during said first set of pulses to cause the image carrier to be exposed, and emit sufficient light during said second set of pulses to maintain exposure of the image carrier.

2. The method according to claim 1, wherein said pulses alternately generate positive-phase and inverted-phase potential differences across the electrodes exceeding the preset threshold value at which the electroluminescent elements emit light.

3. A method for driving a line head having a plurality of edge-emission type electroluminescent elements having common electrodes and channel electrodes to form a latent image on an image carrier by exposing the image carrier with a prescribed quantity of light, including the steps of:

supplying a first set of pulses of a series of pulses to the common electrodes of the electroluminescent elements at a fast cycle to rapidly increase emission of light from the electroluminescent elements to the prescribed quantity to expose the image carrier;

subsequently supplying a second set of pulses of the series of pulses to the common electrodes of the electroluminescent elements at a slow cycle slower than the fast cycle to maintain emission of light from the electroluminescent elements above the prescribed quantity to maintain exposure of the image carrier; and wherein pulses are supplied to the channel electrodes of the electroluminescent elements in synchronism with the supply of the first series of pulses to the common electrodes to selectively cause a potential difference across the common electrodes and channel electrodes to exceed a predetermined value at which the electroluminescent elements emit light.

4. The method according to claim 3 further including a step of counting a number of pulses supplied to one of the common electrodes of the electroluminescent elements, and a step of changing the supply of pulses to the common electrode from the first set of pulses to the second set of pulses when the counted number of pulses reaches a prescribed value.

5. An apparatus for driving edge-emission type electroluminescent elements to emit light to expose an image carrier and to form image data clearly on the image carrier, comprising:

edge-emission type electroluminescent elements having electrodes and emitting light when a potential difference across the electrodes exceeds a preset threshold value;

power supply means for supplying electric pulses to the electrodes of the edge-emission type electroluminescent elements to cause the potential difference across the electrodes to exceed the preset threshold value so that the edge-emission type electroluminescent elements emit light; and pulse control means for controlling the power supply means to supply a series of pulses for each pixel of image data, said series of pulses comprising a first set of pulses supplied at a first cycle to cause the edge-emission type electroluminescent elements to emit light to expose the image carrier, and a second set of pulses supplied at a second cycle slower than the first cycle to cause the edge-emission type electroluminescent elements to emit light to maintain exposure of the image carrier.

6. The apparatus according to claim 5, wherein said pulse control means controls the power supply means to alternately generate positive-phase and inverted-phase potential differences across the electrodes exceeding the preset threshold value at which the electroluminescent elements emit light.

7. An apparatus for driving a line head having a plurality of edge-emission type electroluminescent elements to form a latent image on an image carrier by exposing the image carrier with a prescribed quantity of light, comprising:

supply means for supplying a series of pulses to the edge-emission type electroluminescent elements to selectively cause the edge-emission type electroluminescent elements to generate light;

control means for controlling the supply means to supply a first set of the series of pulses at a first cycle to cause the edge-emission type electroluminescent elements to rapidly emit light to expose the image carrier, and to supply a second set of the series of pulses at a second cycle slower than the first cycle.

8. The apparatus according to claim 7, wherein said control means includes counting means for counting a number of pulses supplied to one of the edge-emission type electroluminescent elements, and changing means for controlling the supply means to change the supply of pulses from the first set of pulses to the second set of pulses when the number of pulses counted by the counting means reaches a prescribed value.

9. An image forming apparatus for forming image data clearly on an image carrier by driving edge-emission type electroluminescent elements to emit light to expose the image carrier, comprising:

a line head having an array of edge-emission type electroluminescent elements arranged in a major scanning direction of the image carrier, each edge-emission type electroluminescent element having electrodes and emitting light when a potential difference across the electrodes exceeds a preset threshold value;

power supply means for supplying electric pulses to the electrodes of selected edge-emission type electroluminescent elements on the line head to cause the potential difference across the electrodes of the selected edge-emission type electroluminescent elements to exceed the preset threshold value so that the selected edge-emission type electroluminescent elements emit light, said selected edge-emission type electroluminescent elements being selected on the basis of the image data; and pulse control means for controlling the power supply means to supply a series of pulses for each pixel of image data, said series of pulses for each pixel comprising a first set of pulses supplied at a first cycle to cause the selected edge-emission type electroluminescent elements to emit light to expose the image carrier, and a second set of pulses supplied at a second cycle slower than the first cycle to cause the selected edge-emission type electroluminescent elements to emit light to maintain exposure of the image carrier.

10. The apparatus according to claim 9, wherein said pulse control means controls the power supply means to alternately generate positive-phase and inverted-phase potential differences across the electrodes of the selected edge-emission type electroluminescent elements exceeding the preset threshold value at which the edge-emission type electroluminescent elements emit light.

11. The apparatus according to claim 9, wherein said line head includes a plurality of blocks, each block having a predetermined number of edge-emission type electroluminescent elements, and wherein said pulse control means time-division controls the supply of pulses to the edge-emission type electroluminescent elements of each block.

12. The apparatus according to claim 11, wherein said power supply means comprises a channel driver connected to each block for applying a voltage to a channel electrode of the edge-emission type electroluminescent elements of each block, and a corresponding common driver connected to each block for applying a voltage to a common electrode of the edge-emission type electroluminescent elements of each block, and wherein said pulse control means time-division controls the supply of voltage to the common electrode of each block.

* * * * *